US007063230B2

(12) United States Patent
Ciccone

(10) Patent No.: US 7,063,230 B2
(45) Date of Patent: Jun. 20, 2006

(54) CONTAINER WITH HINGED LID

(75) Inventor: Vince Ciccone, Kleinburg (CA)

(73) Assignee: Injectnotech Inc., Mississauga (CA)

( * ) Notice: Subject to any disclaimer, the term of this patent is extended or adjusted under 35 U.S.C. 154(b) by 30 days.

(21) Appl. No.: 10/468,947

(22) PCT Filed: Dec. 19, 2002

(86) PCT No.: PCT/CA02/01975

§ 371 (c)(1),
(2), (4) Date: Aug. 22, 2003

(87) PCT Pub. No.: WO03/051732

PCT Pub. Date: Jun. 26, 2003

(65) Prior Publication Data

US 2004/0079757 A1 Apr. 29, 2004

Related U.S. Application Data

(60) Provisional application No. 60/340,842, filed on Dec. 19, 2001.

(30) Foreign Application Priority Data

Feb. 15, 2002 (CA) ..... 2372275
May 17, 2002 (CA) ..... 2386949

(51) Int. Cl.
*B65D 39/00* (2006.01)

(52) U.S. Cl. ..... 220/792; 220/840

(58) Field of Classification Search ..... 220/792, 220/793, 799, 780, 296, 790, 791, 836, 840–845, 220/291, 820, 821, 831, 832; 215/252–256, 215/283

See application file for complete search history.

(56) References Cited

U.S. PATENT DOCUMENTS

| | | | | |
|---|---|---|---|---|
| 2,296,599 | A | 9/1942 | Costello | |
| 3,860,141 | A * | 1/1975 | Hawk | 220/831 |
| 4,735,337 | A | 4/1988 | Von Holdt | |
| 4,971,220 | A * | 11/1990 | Kaufman et al. | 220/832 |
| 5,065,887 | A * | 11/1991 | Schuh et al. | 220/835 |
| 5,238,135 | A * | 8/1993 | Landis | 220/276 |
| 5,366,104 | A * | 11/1994 | Armstrong | 220/832 |
| 5,626,251 | A * | 5/1997 | Luburic et al. | 220/276 |

(Continued)

FOREIGN PATENT DOCUMENTS

EP 0052172 5/1982

(Continued)

*Primary Examiner*—Lien M. Ngo
(74) *Attorney, Agent, or Firm*—Ladas & Parry LLP

(57) ABSTRACT

A container (22) includes a container body (26) having an open end (34) bounded by a thickened rim (32) having a linear part (36) defining a pintle; a lid body (40) overlying the rim (32) in a closed position and having a channel (46) which includes a linear part (42) defining a socket (66) and having a concave wall (67) extending in close-fitting relation through greater than 180 degrees of the circumferential extent of the pintle around an axis defined thereby to hingably couple the lid body (40) to the container body (26). A container flange (28) extends outwardly around the container body (26) in spaced relation to the rim (32). A skirt (38) is detachable from the lid body (40), and extends therefrom in surrounding relation to the container flange (28) and has a lid flange (56) which extends around and grips the underside of the container flange (28) such that, upon detachment of the skirt (38), the lid body (40) is pivotally movable about the axis to an open position apart from the open end (34).

21 Claims, 23 Drawing Sheets

U.S. PATENT DOCUMENTS

| | | | | |
|---|---|---|---|---|
| 5,730,309 | A * | 3/1998 | Jiradejnunt et al. | 220/276 |
| 6,279,774 | B1 * | 8/2001 | Clute et al. | 220/792 |
| 6,619,498 | B1 * | 9/2003 | von Holdt, Jr. | 220/276 |
| 6,688,483 | B1 * | 2/2004 | Davis | 220/276 |

FOREIGN PATENT DOCUMENTS

| | | |
|---|---|---|
| EP | 0723918 | 7/1996 |
| FR | 2103410 | 4/1972 |
| GB | 450087 | 7/1936 |

* cited by examiner

CONTAINER WITH HINGED LID

RELATED U.S. APPLICATION DATA

Provisional application No. 60/340,842 filed on Dec. 19, 2001.

FIELD OF THE INVENTION

This invention relates to plastic lidded containers.

BACKGROUND OF THE INVENTION

In plastic lidded containers, it is desirable to provide a strong attachment and good seal between the container and the lid, especially for shipping purposes. Usually, interlocking or inter-engaging flanges are provided respectively on the lid and the upper peripheral edge portion of the container to retain the lid on the container. The difficulty is that the stronger the engagement between these interlocking flanges, and thus the stronger the attachment of the lid to the container, the more difficult it is to remove the lid when it is desired to do so. Ideally, one would like to have good engagement between the lid and the container for shipping purposes, and some means for relieving or reducing the force of engagement between the lid and the container when it is desirable to remove the lid One method of accomplishing the above objectives is to provide the lid with a tear-off strip that contains the lid locking flange that engages the container locking flange. When the lid is on the container, the engaged locking flanges hold the lid securely onto the container. When it is desired to remove the lid, the lid tear-off strip is removed, so there is no longer any locking engagement between the lid and the container.

However, while this method facilitates removal of the lid, it suffers to the extent that it does not provide for a secure fit between the lid and the container after the tear-off strip has been removed. As well, as there is no residual physical connection between the container and lid, the lid may need to be set down on a suitable surface for access to be gained to the contents of the container; this can result in the lid becoming soiled, whereupon the contents of the container can become contaminated, or on the surface becoming soiled with the contents of the container.

One method of overcoming the former difficulty, namely, for providing a secure fit between the lid and container after removal of the tear-off strip is shown in U.S. Pat. No. 4,735,337 issued to John W. Von Holdt. In this patent, the lid outer skirt that contains the lid locking flange is provided with a zigzag tear line that defines a tear-off strip. The tear line passes repeatedly through the lid locking flange, so that upon removal of the tear-off strip, only spaced-apart portions of the lid locking flange remain.

As to the latter difficulty, it will be evident that, in the case of a rectangular lid having two parts separated by an integral hinge (i.e. a linear portion formed of flexible material), if the lid locking flange is retained along a first of said parts, and intermittently along a second of said parts (for example, by the Von Holdt method), the first part will be relatively securely fastened to the container, while the second is relatively easily hingedly removed, to permit access to the contents. However, inter alia, this method suffers in that, in order to provide for secure fastening, the first part must block at least a portion of the container opening.

SUMMARY OF THE INVENTION

In the present invention, a container and a lid are provided. The container includes a hollow container body having a thickened peripherally extending rim and an open end bounded by the rim. The rim defines a periphery of the container body and has a linear part. The linear part of the rim defines a pintle, and the pintle defines a pintle axis. The lid includes a lid body. The lid body overlies the rim in a closed position and has a channel formed therein which includes a linear part. The linear part of the channel defines a socket and has a concave wall that extends in close-fitting relation through greater than 180 degrees of the circumferential extent of the pintle around the pintle axis to hingably couple the lid body to the container body for movement from the closed position to an open position where the lid body is disposed at an angle to the open end of the container.

In accordance with a further aspect of the invention there is further provided a container locking flange, rigidly connected to the container body and peripherally extending around the exterior thereof in spaced relation to the rim. A peripheral skirt is detachably connected to the lid body and extends therefrom in surrounding relation to the container locking flange. The skirt has an inwardly-disposed lid locking flange which extends peripherally around the container body and grips the underside of the container locking flange to prevent removal of the lid body from the container body. Upon detachment of the skirt, the lid body is pivotally movable between the closed position and the open position.

Other advantages, features and characteristics of the present invention, as well as methods of operation and functions of the related elements of the structure, will become more apparent upon consideration of the following description with reference to the accompanying drawings, the latter of which being briefly described herein below.

BRIEF DESCRIPTION OF THE DRAWINGS

A preferred embodiment of the invention will now be described, by way of example, with reference to the accompanying drawings, in which.

DETAILED DESCRIPTION OF THE PREFERRED EMBODIMENT

Figure 1:
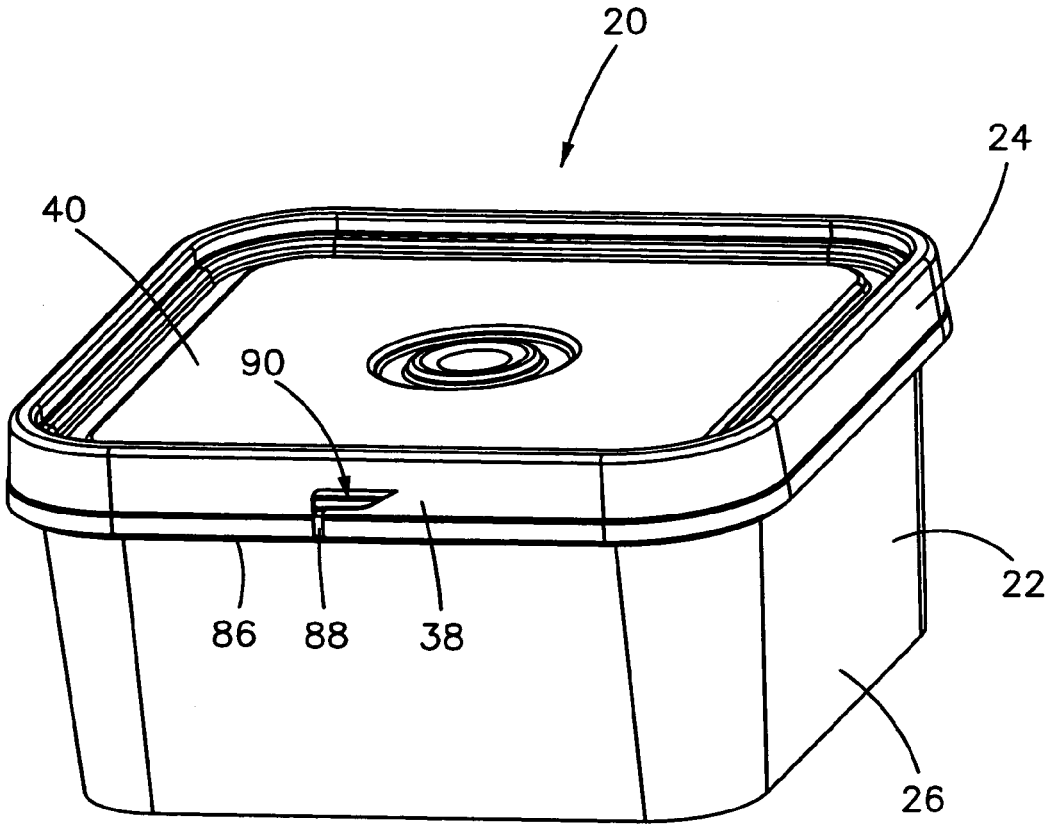
FIG. 1 is a front, top perspective view of apparatus according to a preferred embodiment of the present invention.

In the description below, like reference numerals are used to indicate components which are similar in the various embodiments of the present invention. Primed reference numerals are used to indicate different variants of the similar components. Referring to FIG. 1, a preferred embodiment of the present invention is generally designated by reference numeral 20 and comprises a container 22 and a lid 24, the structures of which parts will firstly be described.

Figure 8:
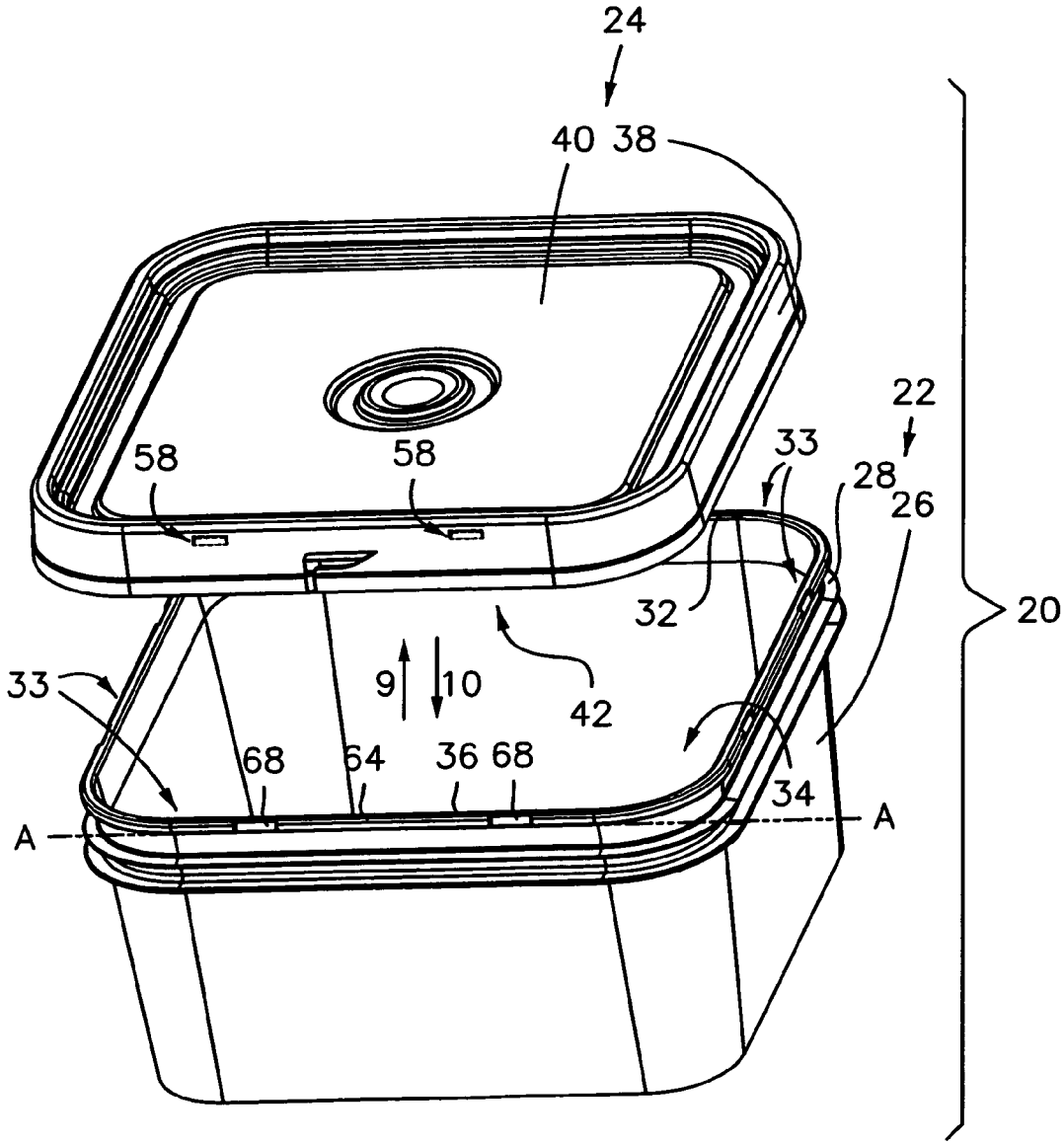
FIG. 8 is an exploded perspective view of the structure of FIG. 1.

As best illustrated in FIG. 8, the container 22 includes a hollow container body 26 (actually, a substantially square bucket in the preferred embodiment) and a container locking flange 28.

The container body 26 has a thickened rim 32 and an open end 34 bounded by the rim 32. The rim 32 defines a periphery 33 of the container body 26 and includes a linear part 36 which defines a pintle 64. The pintle 64 itself defines a pintle axis A—A.

The container locking flange 28 is rigidly connected to the container body 26 and peripherally extends around the exterior thereof in spaced relation to the rim 32. In the preferred embodiment illustrated, the container locking flange 28 is formed integrally with the container body 26.

As illustrated in FIG. 8, the lid 24 includes a lid body 40 and a peripheral skirt 38.

Figure 3A:
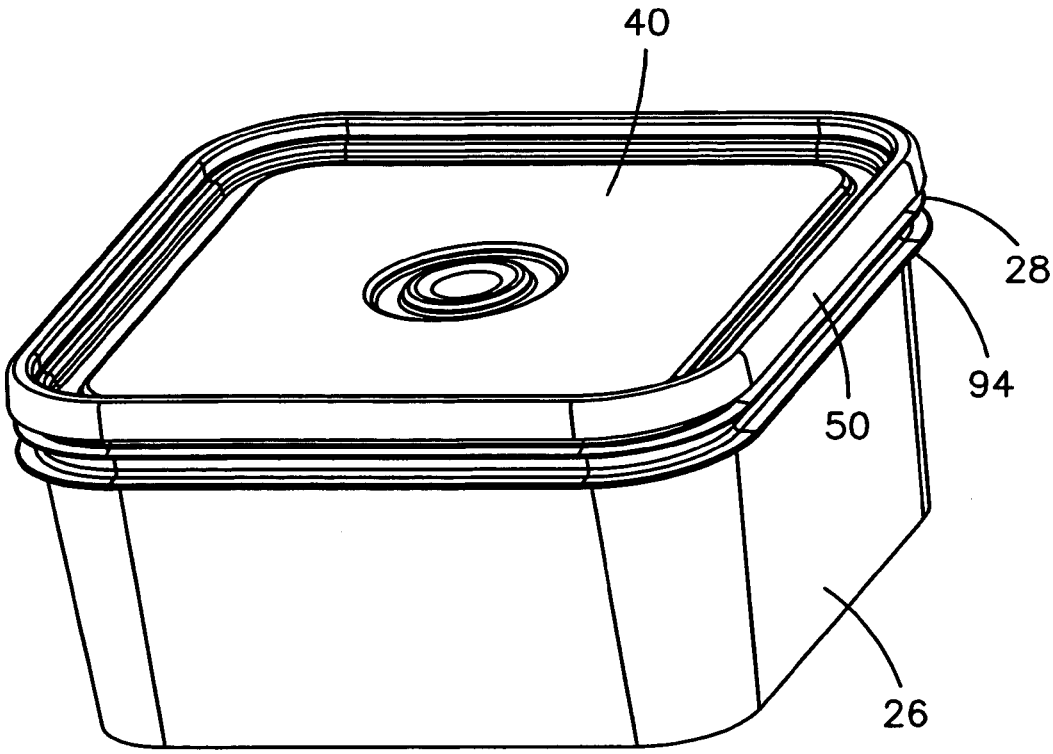
FIG. 3A is a view similar to FIG. 1, with the skirt completely removed.
Figure 9:
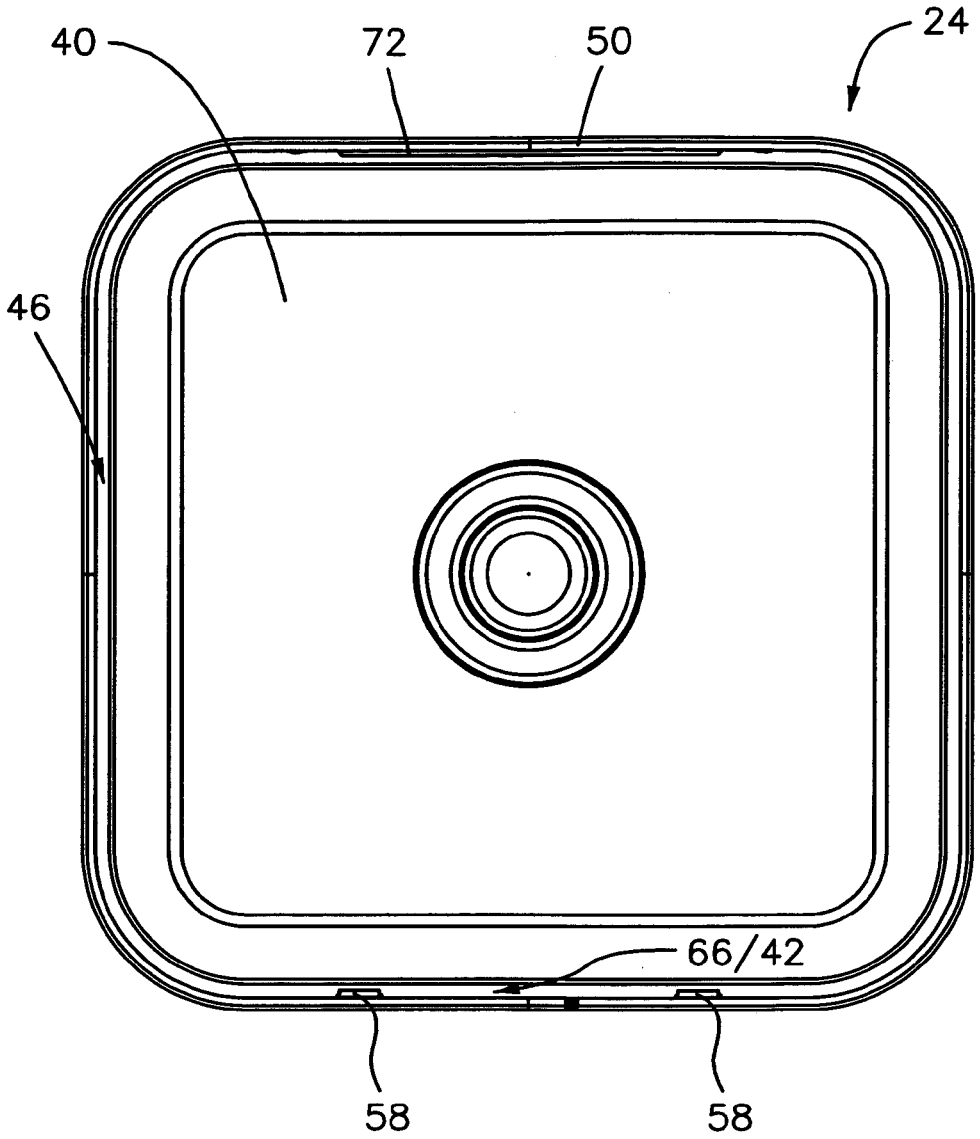
FIG. 9 is a view along arrow 9 of FIG. 8.

The lid body 40 is illustrated in FIG. 3A overlying the rim 32 (rim 32 not being visible) in a closed position. As best seen in FIG. 9, the lid body 40 has a channel 46 formed therein which includes a linear part 42 . The linear part 42 defines a socket 66 and has a concave wall 67 best seen in FIG. 14 that extends, in close-fitting relation through greater than 180 degrees of the circumferential extent of the pintle 64 around the pintle axis A—A to hingably couple the lid body 40 to the container body 26, as discussed more fully in following paragraphs.

Figure 7:
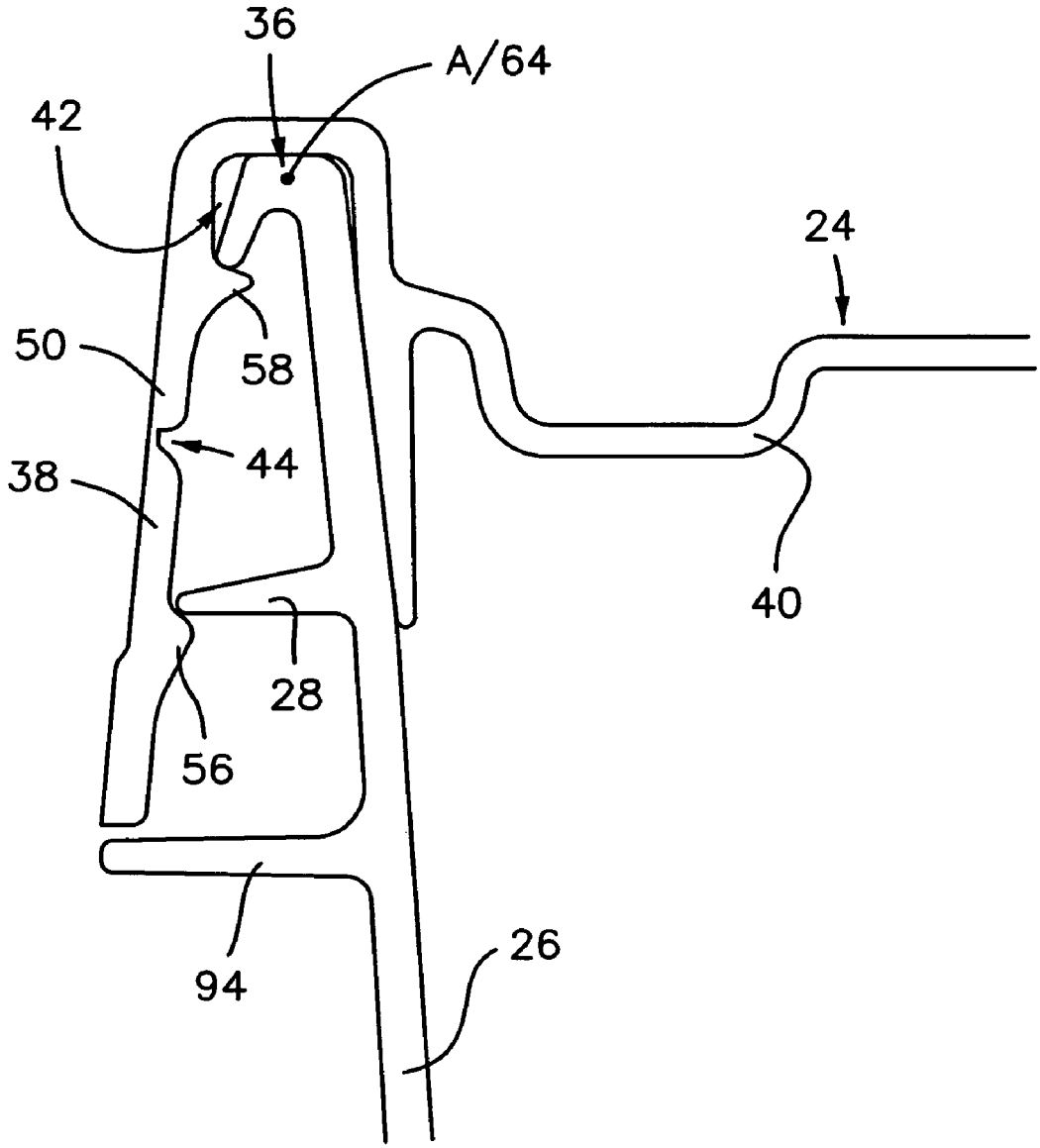
FIG. 7 is a partial cross-sectional view of the structure of FIG. 1, viewed along line 7—7 in FIG. 5.

Skirt 38 is detachably connected (in the preferred embodiment, it is a tear-off strip, as discussed more fully in following paragraphs) to lid body 40 and extends therefrom in surrounding relation to the container locking flange 28, as indicated in FIG. 7. The skirt 38 has an inwardly-disposed lid locking flange 56 which extends peripherally around the container body 26 and grips the underside of the container locking flange 28 to prevent removal of the lid body 40 from the container body 26, also as seen in FIG. 7. As this general type of container is typically assembled by applying high forces to the respective parts and urging same together, by press or the like, it will be appreciated by persons of ordinary skill in the art that, typically, at least the corners of the lid 24 will be relieved, by the omission of sections of the lid locking flange 56, and the lid 24 and the container 22 will be constructed out of a suitable resilient material, such as polyethylene or polypropylene, thereby to permit same to be press-fit together, using conventional techniques.

Figure 2:
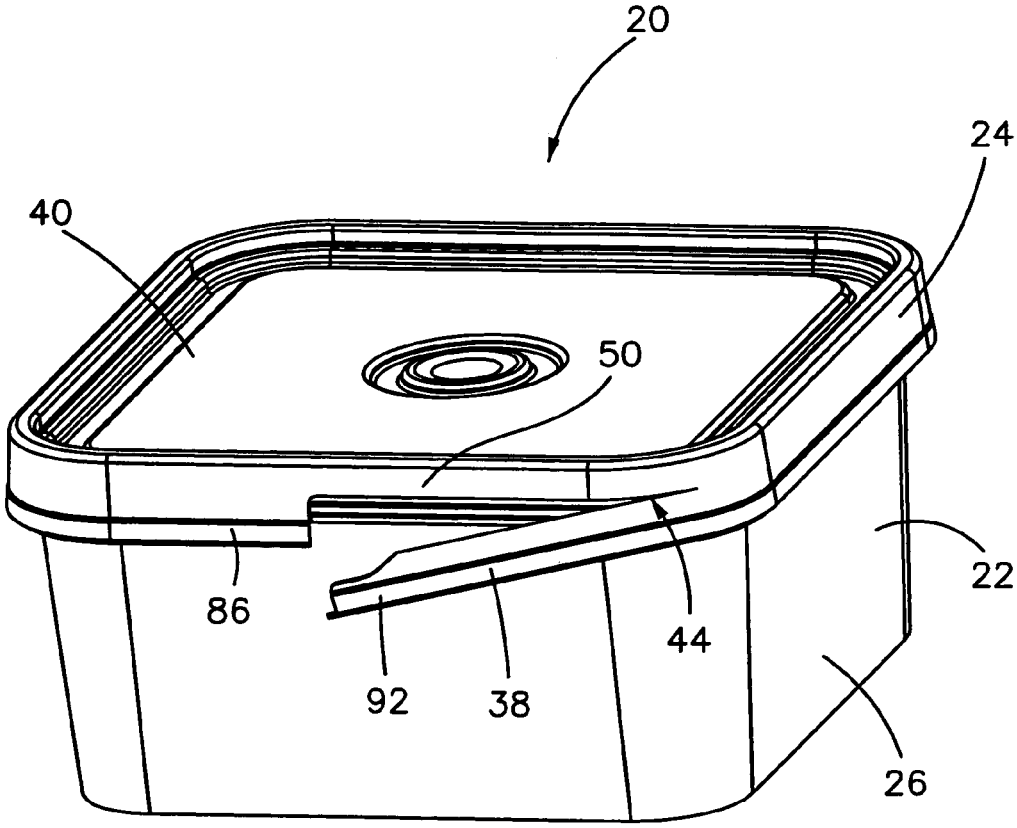
FIG. 2 is a view similar to FIG. 1, showing a skirt of the lid partially removed.
Figure 3B:
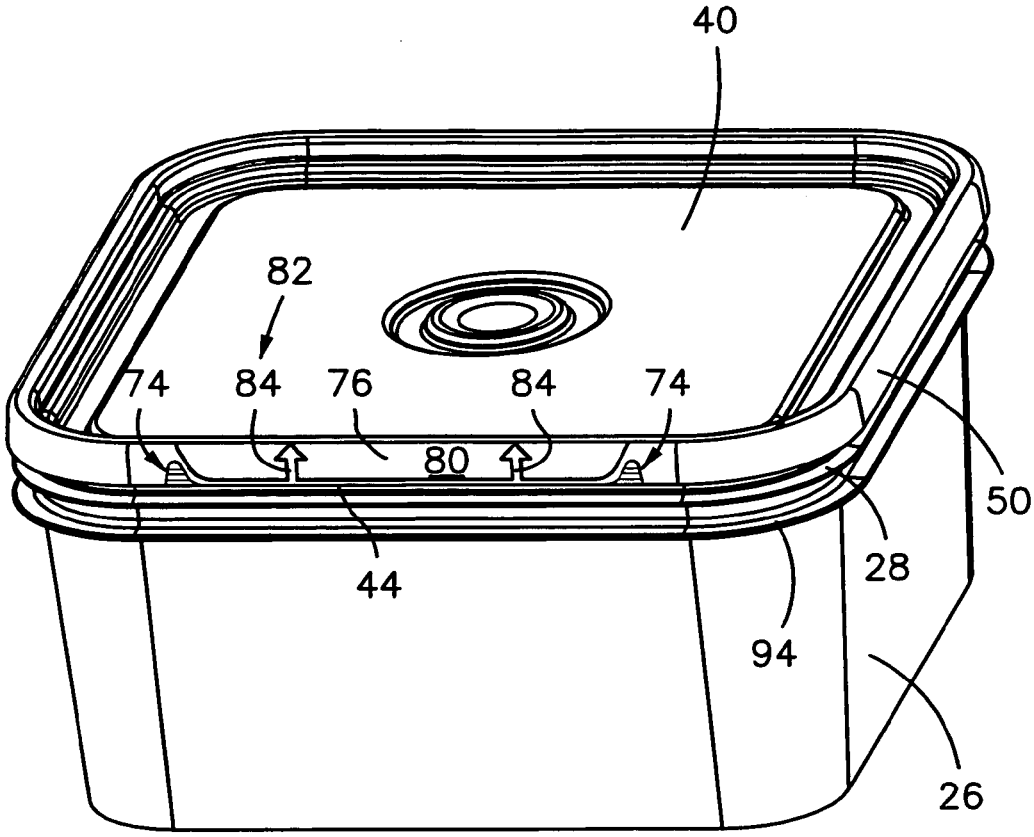
FIG. 3B is a rear, top perspective view of the container of FIG. 1, with the skirt completely removed.
Figure 4A:
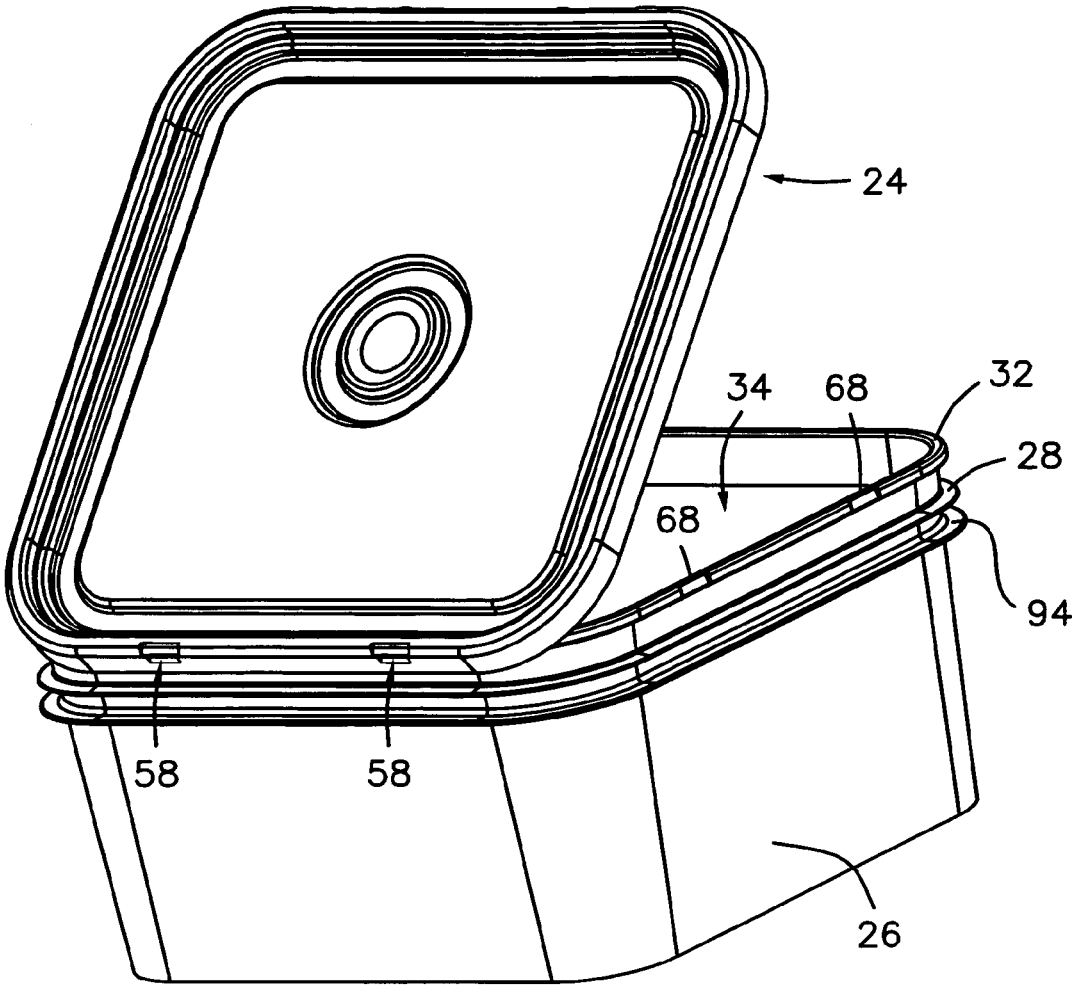
FIG. 4A is a view similar to FIG. 3A, with the lid body pivoted relative to the container body.
Figure 4B:
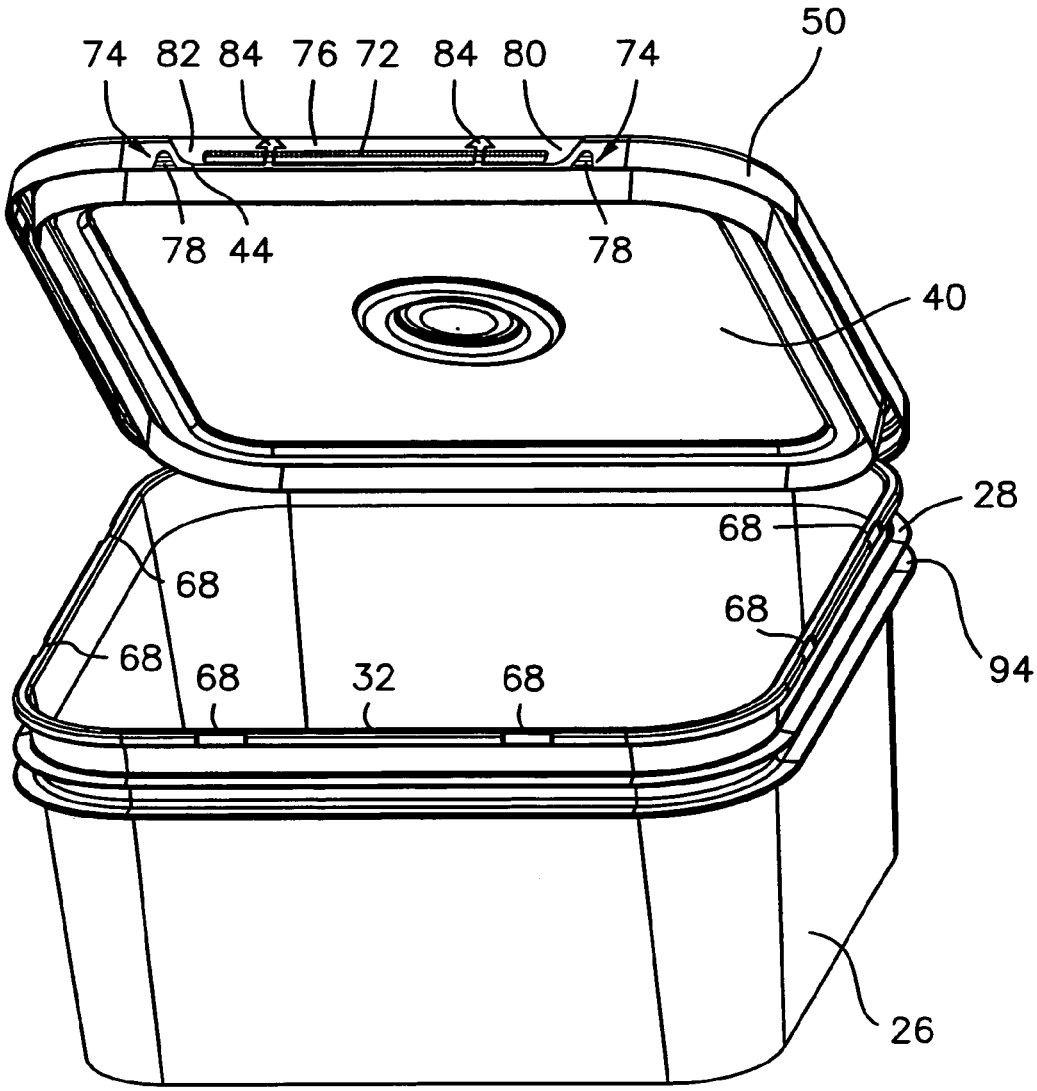
FIG. 4B is a view similar to FIG. 3B, with the lid body pivoted relative to the container body.
Figure 5:
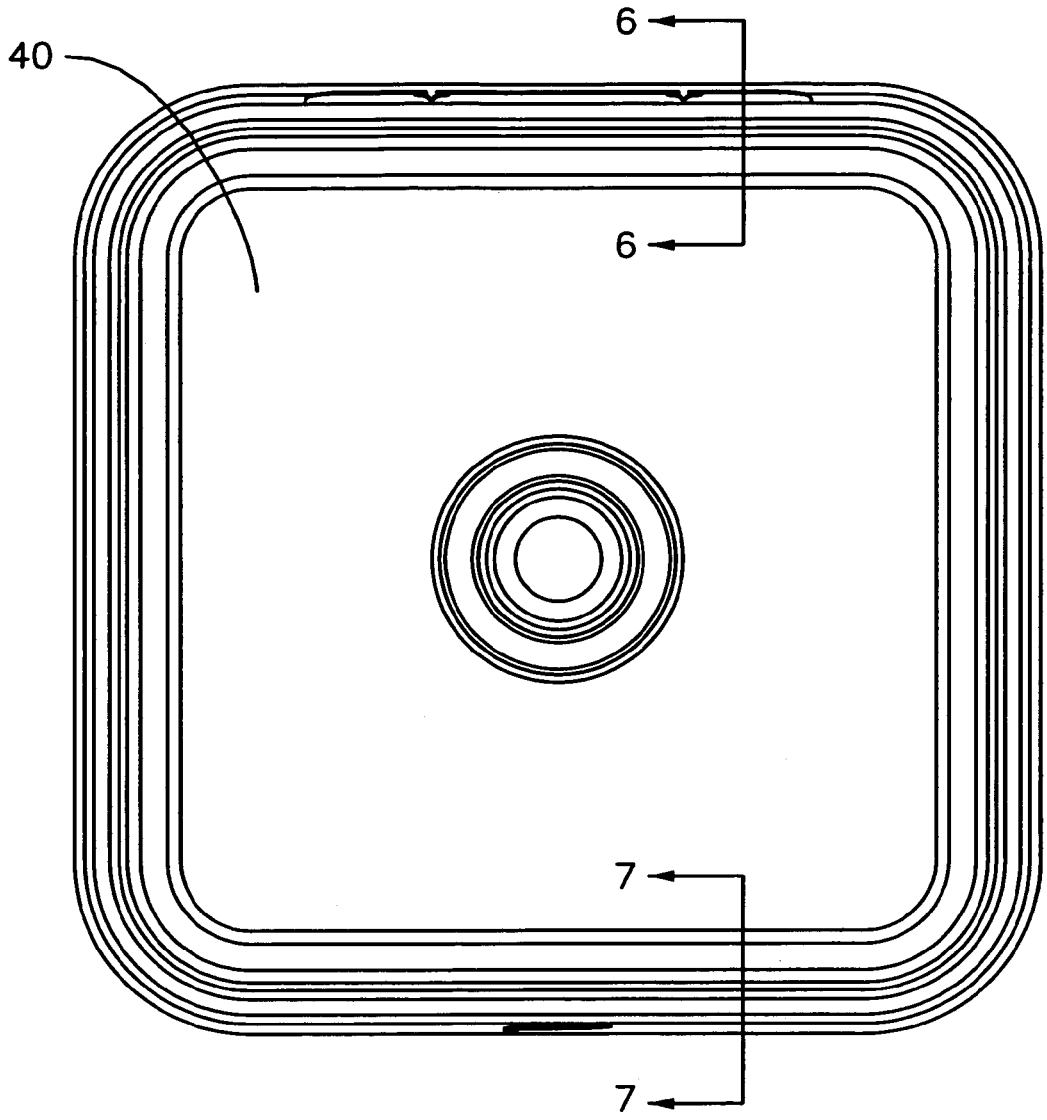
FIG. 5 is a top view of the structure of FIG. 1.
Figure 13:
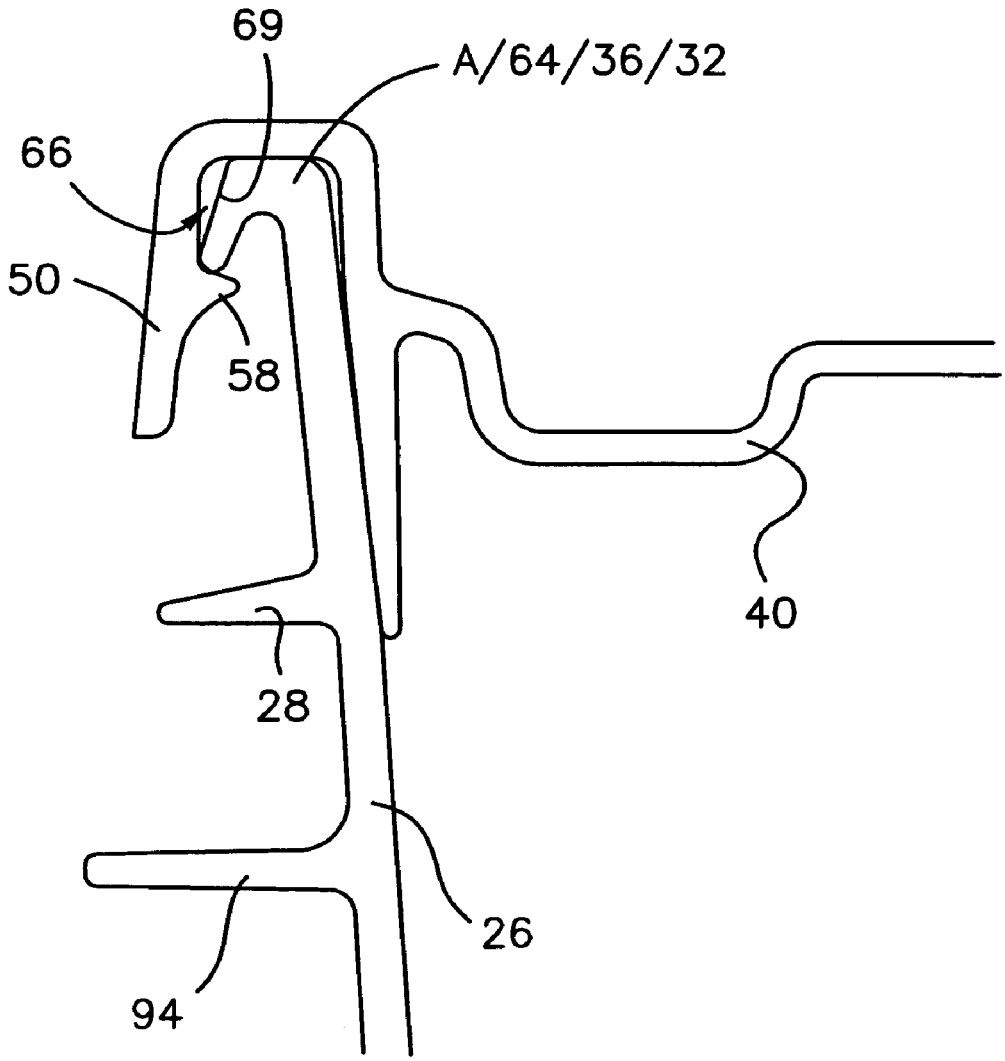
FIG. 13 is a partial cross-sectional view along line 13—13 of FIG. 11.
Figure 14:
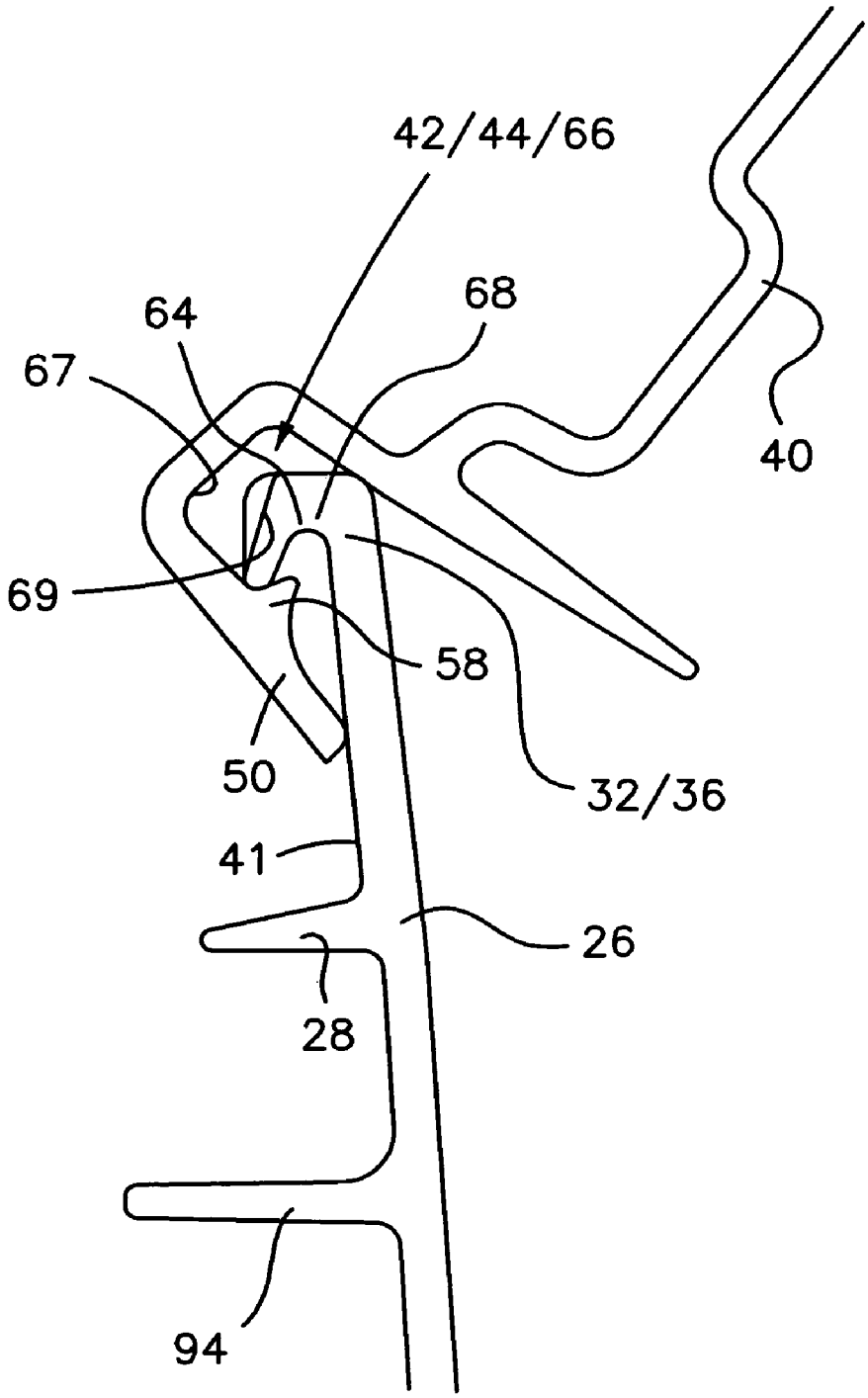
FIG. 14 is a view similar to FIG. 13, showing the lid body pivoted relative to the container body.

In any event, it will be evident that the foregoing elements alone provide a useful structure in that, for shipping, the invention can be used with skirt 38 connected to the lid body 40 (as shown inter alia in FIG. 1), with reasonable assurance that, under normal handling conditions, the lid body 40 and container body 26 will not become separated and spill any goods contained therein, while providing an ability, when access to the contents is required, for the detachment of the skirt 38 (as indicated by the sequence of FIGS. 1, 2 and 3A), whereupon the lid body 40 may be pivoted about the pintle axis A—A from the closed position shown in FIGS. 3A, 3B and 13 to an open position, shown in FIGS. 4A, 4B and 14, where the lid body 40 is disposed at an angle to the open end 34 of the container 22.

However, further features are also provided in the preferred embodiment.

As one further feature, the concave wall 67 is defined in part by one or more protruding hooked portions 58 which grip the underside of the linear part 36 of the rim 32 (actually, two spaced-apart hooked portions), as best illustrated in FIG. 9 and FIG. 13. (Hooked portions 58 are also indicated in phantom outline in FIGS. 4A and 8).

Figure 12:
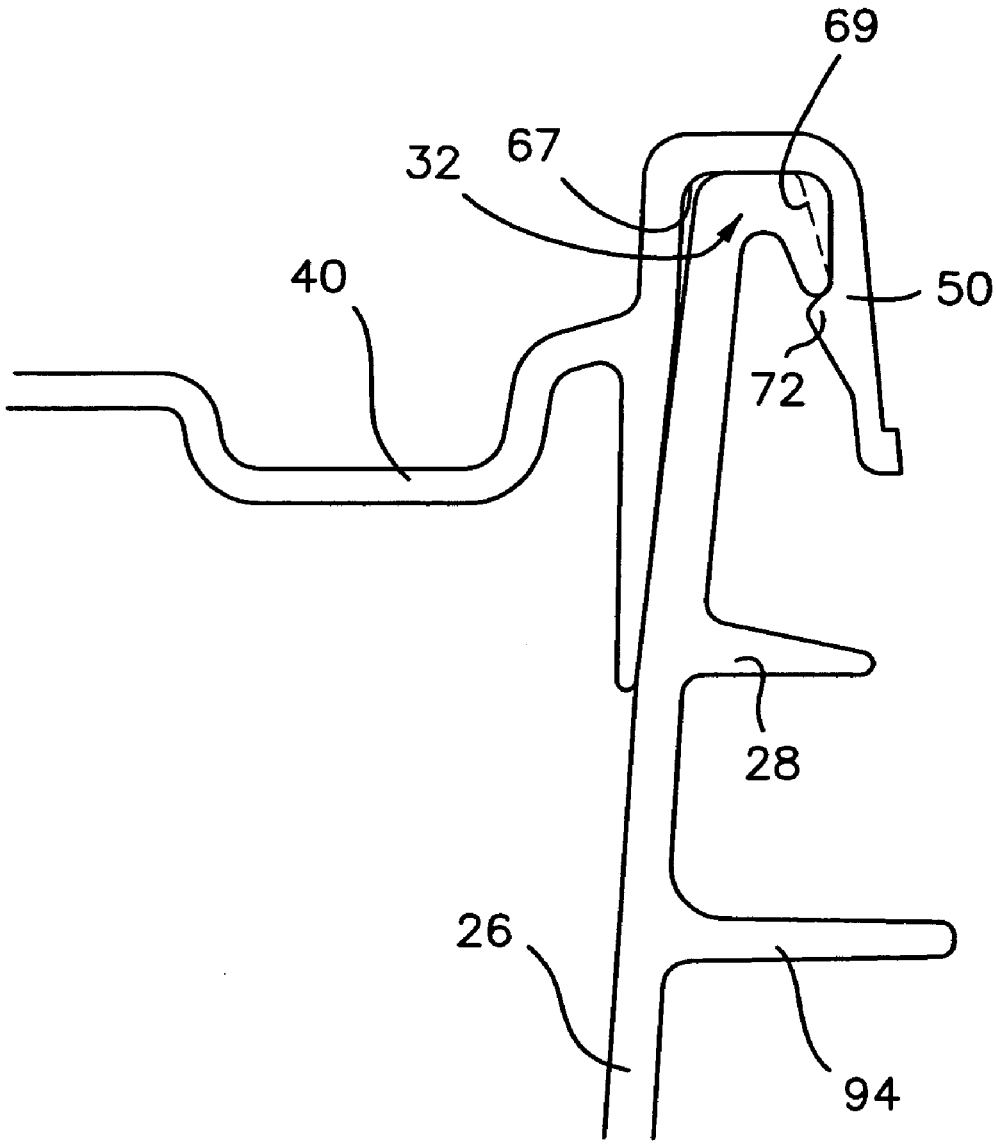
FIG. 12 is partial cross-sectional view along line 12—12 of FIG. 11.

Additionally, the linear part 36 of the rim 32 has formed thereon, for each protruding hooked portion 58, a necked-in orc chamfer portion 68, as best illustrated in FIG. 8, in which the hooked portions 58 travel during assembly. As seen in FIG. 14, wherein a surface 69 of a respective necked-in portion 68 is shown, the necked-in portion 68 tapers in width towards the upper extent of the rim 32, thereby to lessen the forces that would otherwise need be applied during assembly and facilitate insertion of the linear part 36 of the rim 32 within the linear part 42 of the channel 46. Surface 69 is shown in phantom outline in FIG. 12.

Figure 10:
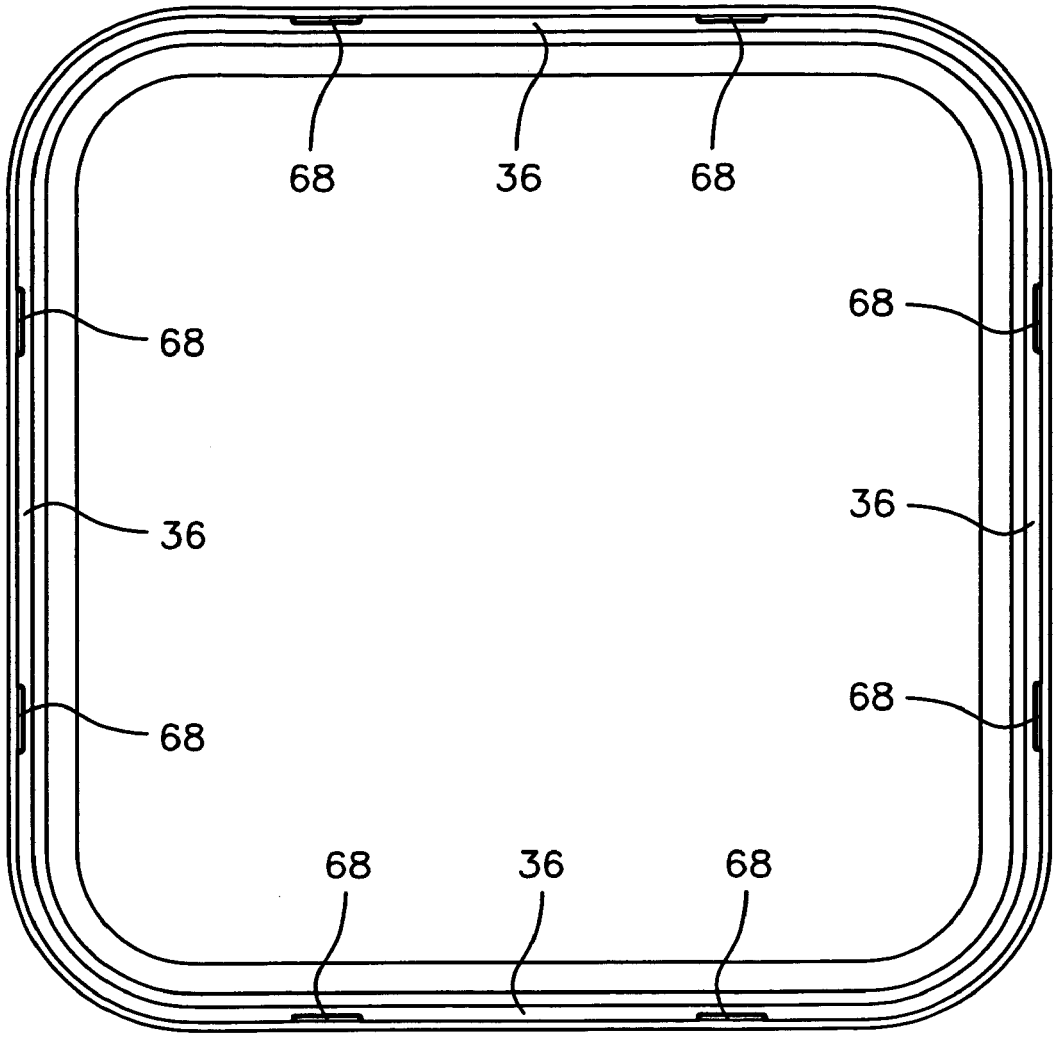
FIG. 10 is a view along arrow 10 of FIG. 8.
Figure 11:
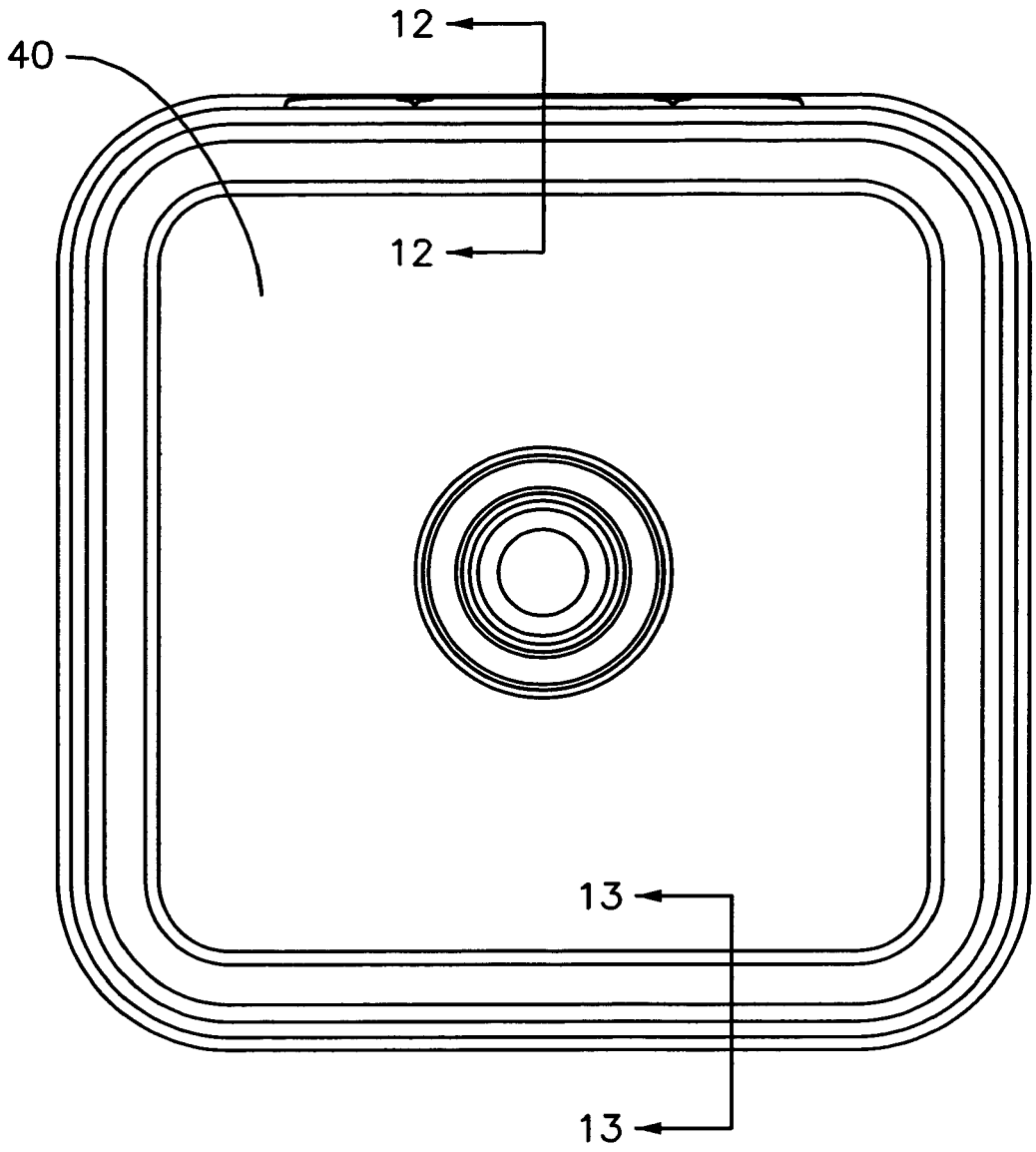
FIG. 11 is a top view of the structure of FIG. 3A.

As aside, it will be noted that, in the preferred embodiment illustrated, the rim 32 is substantially rectangular (actually substantially square) and thus has four linear parts 36 as shown in FIG. 10. Similarly, the lid body 40 is substantially square, with the socket 66 aligned along one side thereof, as indicated in FIG. 9. This also facilitates assembly, to the extent that there is no dedicated pintle, but rather, any one of said linear parts 36 may define the pintle and be disposed within socket 66, thereby obviating the need for the lid 24 and the container 22 to be aligned in any particular directionality prior to assembly.

Figure 6:
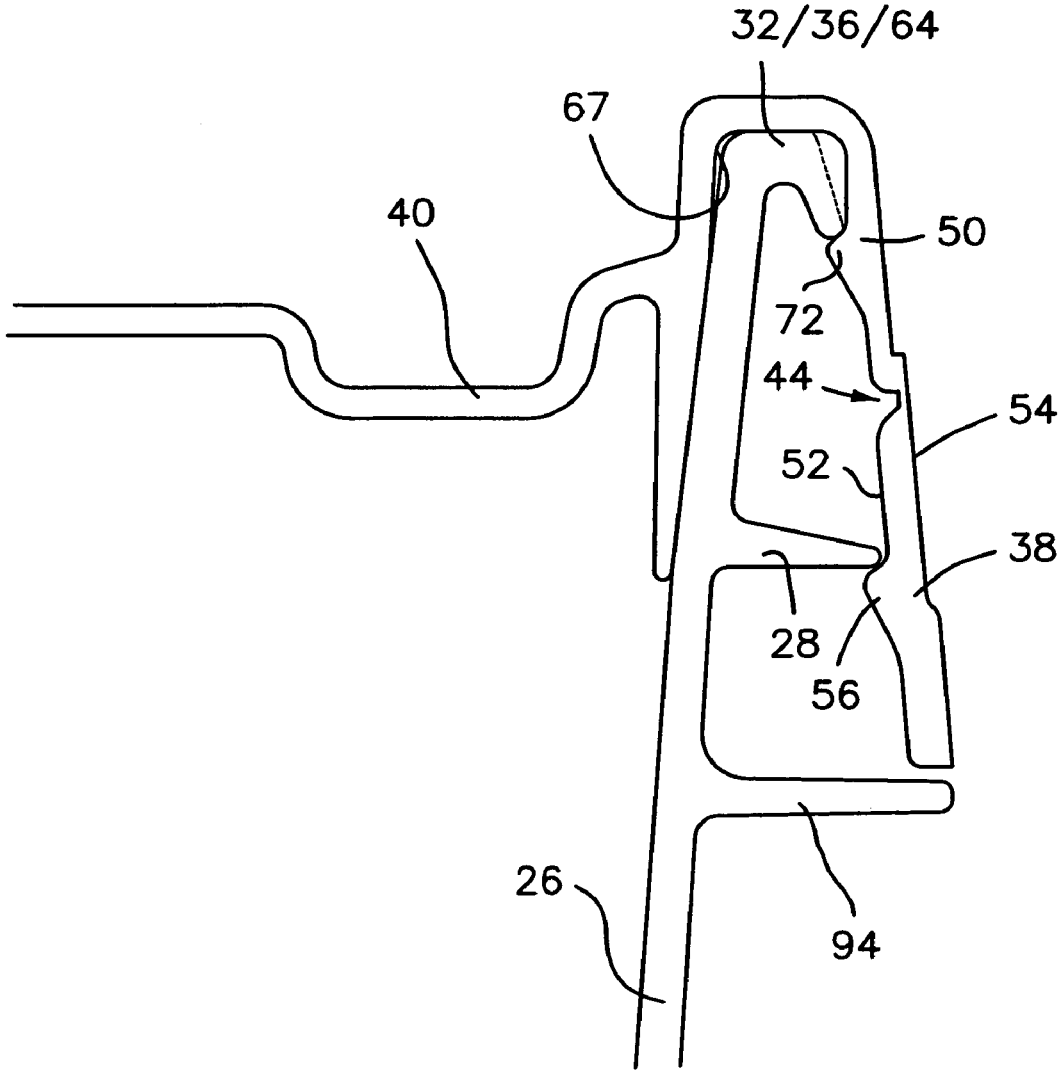
FIG. 6 is a partial cross-sectional view of the structure of FIG. 1, viewed along line 6—6 in FIG. 5.

As another feature of the preferred embodiment, the rim 32 is disposed substantially entirely within the channel 46. That is, channel 46 extends around the lid body 40, as shown in FIG. 9, thereby to define a tubular part 50 to which is detachably connected the skirt 38, as seen in FIG. 6 and 7. In the preferred embodiment, the lid body 40 and the skirt 38 are formed integrally, and divided by a peripheral groove 44 which can be formed on the inside surface 52, as seen in FIG. 6, on the outside surface 54 or partly on both.

As another feature, the lid body 40 is formed with a lid locking flange 72 adjacent to the channel 46. In the preferred embodiment, flange 72 projects inwardly from the tubular part 50 of the lid body 40, is located on the side of the lid body 40 opposite to that with which the socket 66 is aligned, as shown in FIG. 9, and grips the underside of the rim 32 to resist removal of the rim 32 from the channel 46, as indicated, inter alia, by FIG. 12. This provides for a positive closure between the lid body 40 and the container body 26 even following detachment of the skirt 38. The relative size, spacing and position of the lid locking flange 72 can be configured as desired to give desired levels of positive closure. For clarity, lid locking flange 72 is shown in phantom outline in FIG. 4B.

The tubular part 50 of the lid body 40 of the preferred embodiment is also formed with triangularly shaped thin membrane windows 74 therein, as best indicated in FIGS. 3B and 4B, wherein the membrane windows 74 are indicated in phantom outline. Membrane windows 74 are located on either side of the lid locking flange 72, bordering on the peripheral groove 44, so that upon removal of skirt 38 the windows 74 turn into downwardly disposed V-shaped, weakened areas on either side of the lid locking flange 72. This portion of the tubular part 50 (i.e. located between the windows 74) thus becomes a flap 76 that can be pried outwardly and upwardly to release the lid locking flange 72 from the rim 32 and thus allow for pivotal disengagement of the lid body 40 from the container body 26. The thin membrane windows 74 can stretch elastically and act as springs to help return flap 76 to its original (locking) position. The membranes of windows 74 typically are about 0.2 to 0.5 mm (0.008 to 0.020 inches) thick. In the preferred embodiment, membrane windows 74 have reinforcing ribs 78 (also indicated in phantom outline in FIG. 4B). This minimizes the likelihood that the membranes 74 will tear upon the lifting of the flap 76, and also facilitates the return of flap 76 to its original shape.

As yet another feature of the preferred embodiment, the outer surface 80 of the lid body 40 corresponding to the position of the lid locking flange 72 includes indicator means 82 which indicate where flap 76 is located. The indicator means 82 of the preferred embodiment comprises a recessed portion which includes arrows 84 pointing upwardly, as shown in FIGS. 3B and 4B.

Figure 15:
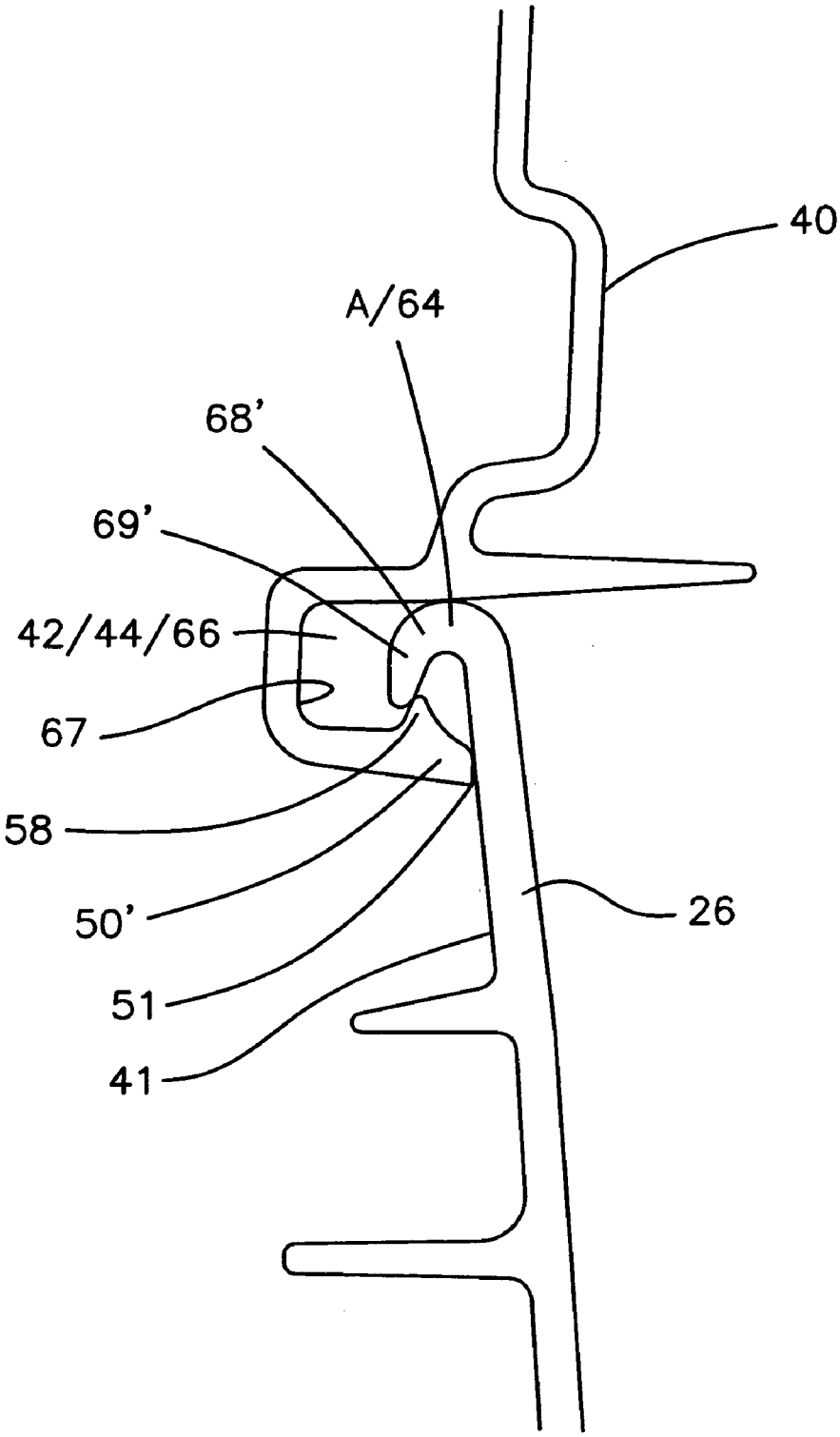
FIG. 15 is a view similar to that of FIG. 14 of an alternative embodiment of the lid of the invention in a 90 degree open position.
Figure 16:
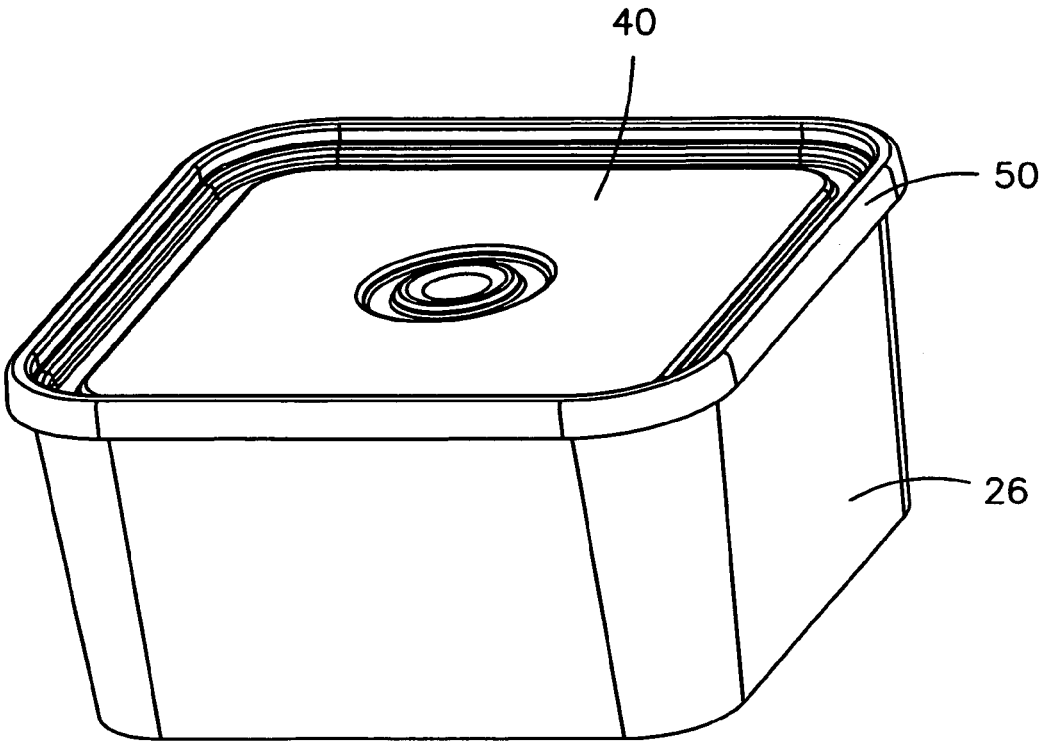
FIG. 16 is a perspective view of an embodiment of the lid and container which does not include a tear off strip or locking flange.
Figure 17:
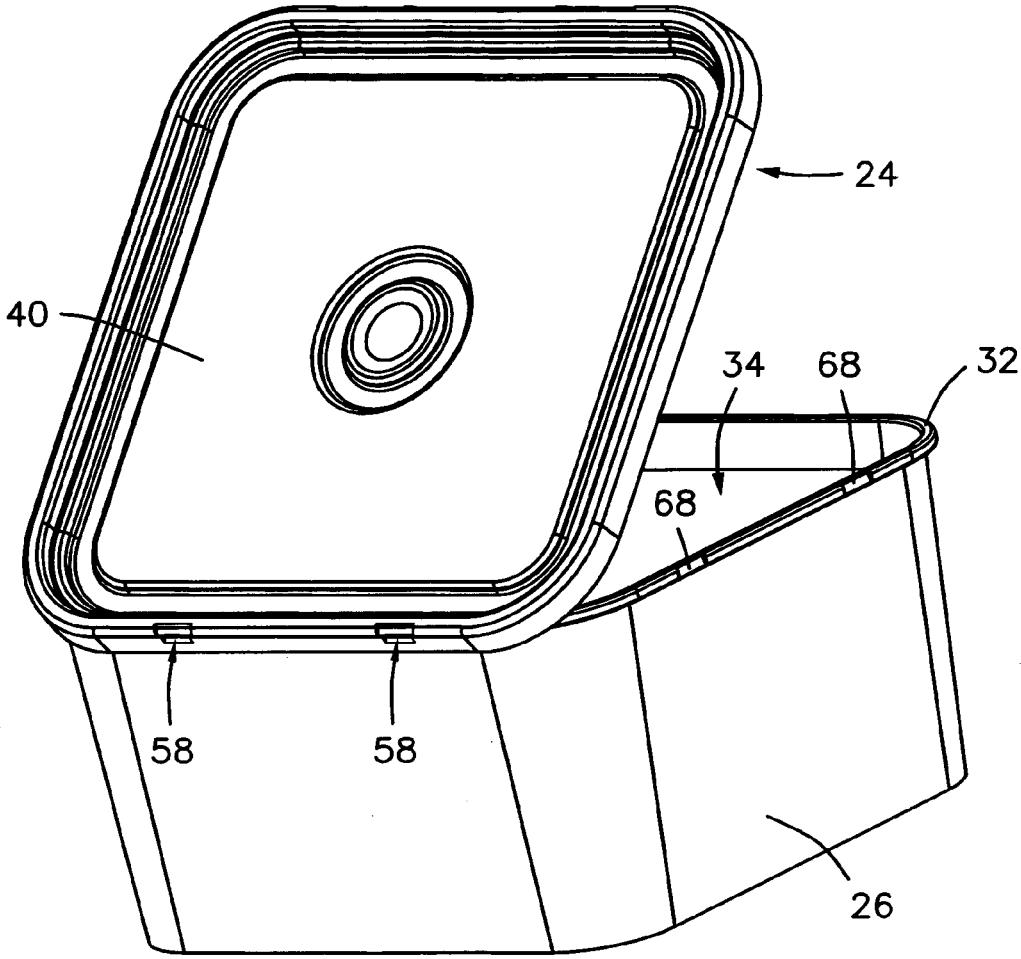
FIG. 17 is a front perspective view of the embodiment of FIG. 16 with the lid body pivoted relative to the container body.
Figure 18:
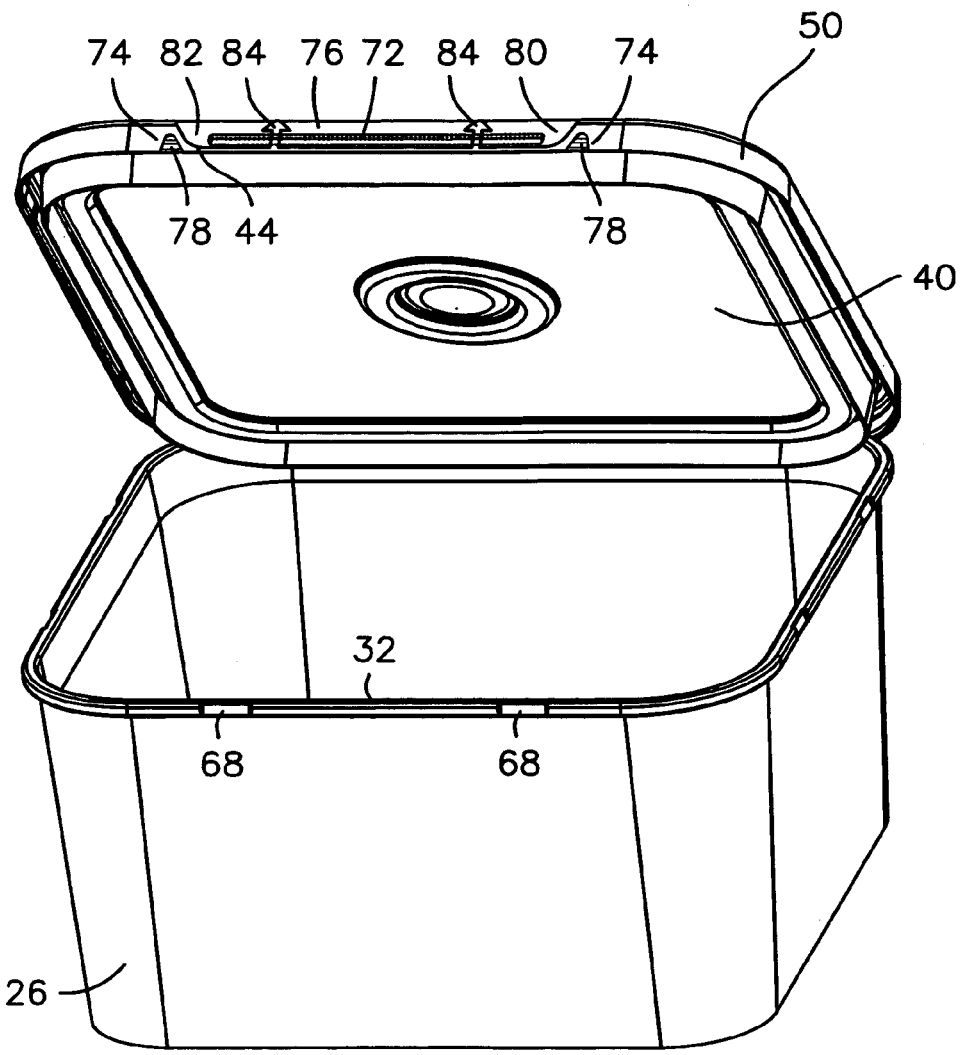
FIG. 18 is rear perspective view of the embodiment of FIG. 16 with the lid body pivoted relative to the container body.
Figure 19:
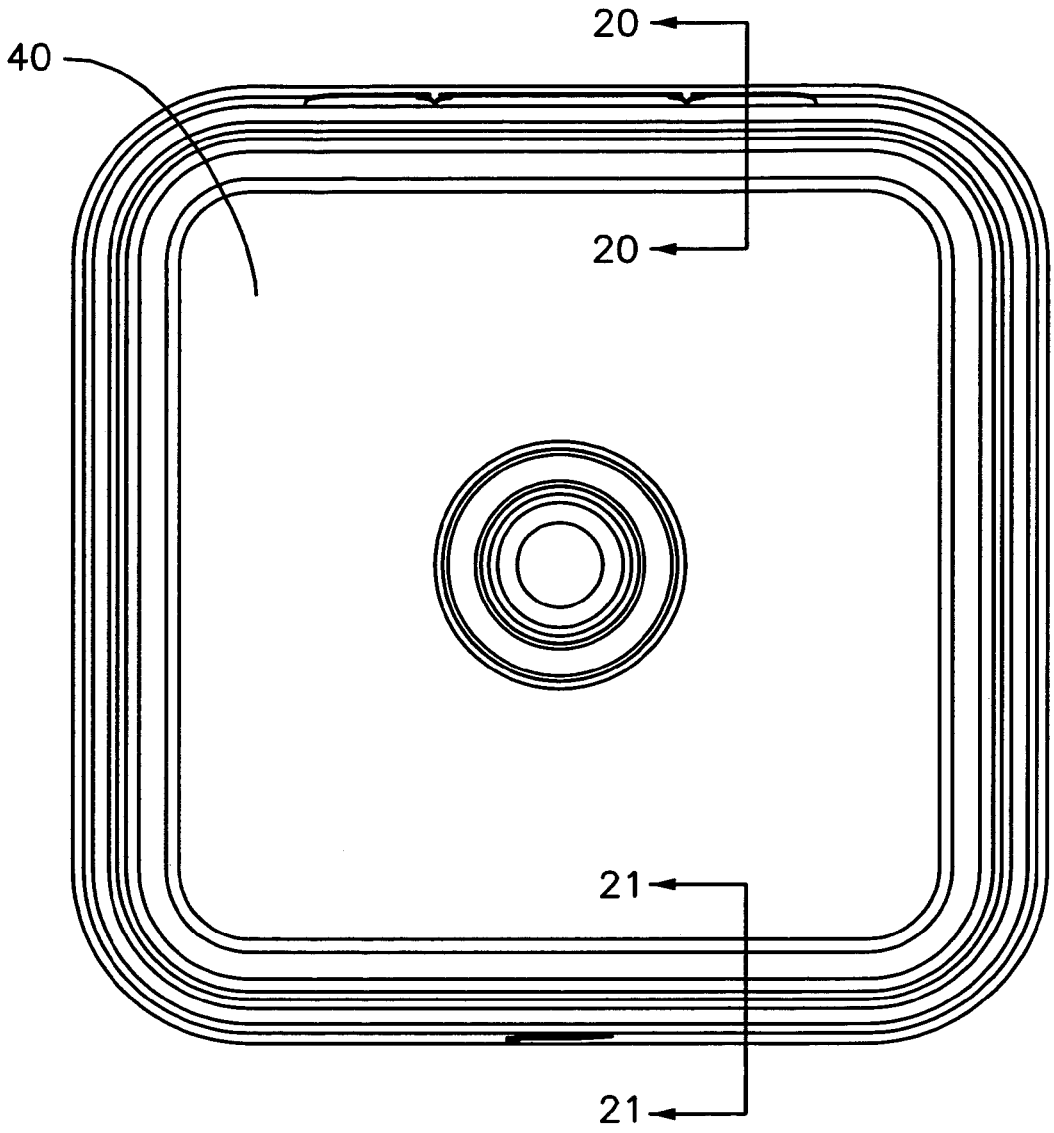
FIG. 19 is a top view of the lid of FIG. 16.

Shown in FIG. 15 is a further embodiment of the lid wherein the tubular part 50' extending from the linear part 42, is shorter relative to that of the embodiment shown in FIGS. 1 to 14. In the embodiment of FIG. 15, once the skirt 38 is removed in the manner discussed below, shortened tubular part 50' allows the lid to be opened more fully than the embodiment of the lid shown in FIG. 14. For example, in the embodiment shown in FIG. 15, the lid may open to a position 90 degrees above the plane of the closed lid. Preferably, when the lid is in this 90 degree open position, an end portion 51 of tubular part 50' is sized to contact the outer surface 41 of the container body 26 in press fit engagement, thereby providing releasable support for the lid in this 90 degree open position. It should be understood that the length of the tubular part 50' may be adjusted for press fit engagement with the outer surface 41 of the container body corresponding to different angles of opening of the lid. As seen in FIG. 15, shown by example, the outer surface 69' of the necked portion 68' may be rounded to promote easy pivoting to the 90 degree open position, however it should be understood that surface 69' may also be of comparable shape to surface 69 of FIG. 14 (i.e. tapering in width toward the upper extent of the rim).

To facilitate its removal, the skirt 38 of the preferred embodiment is also formed with a window 90 spaced from the lower peripheral edge 86 of the skirt 38, and a reduced thickness portion 88 extending between lower peripheral edge 86 and window 90, as illustrated in FIG. 1. To detach skirt 38, one can insert a tool such a screwdriver into window 90 and pry skirt 38 outwardly to break the reduced thickness portion 88. This provides a tab portion 92 of skirt 38, shown in FIG. 2, that can be grasped and pulled outwardly to tear skirt 38 from tubular part 50 along peripheral groove 44.

It will be appreciated that breaking reduced thickness portion 88 is a tamper evidence feature for lid 24. Tamper-resistance is also provided for by the inclusion of barrier flange 94 which, as shown in FIG. 7 extends peripherally about container body 26 beneath the container locking flange 28, at the base of the skirt 38, to restrict the ability of persons to pry the lid 24 from the container body 26.

Figure 20:
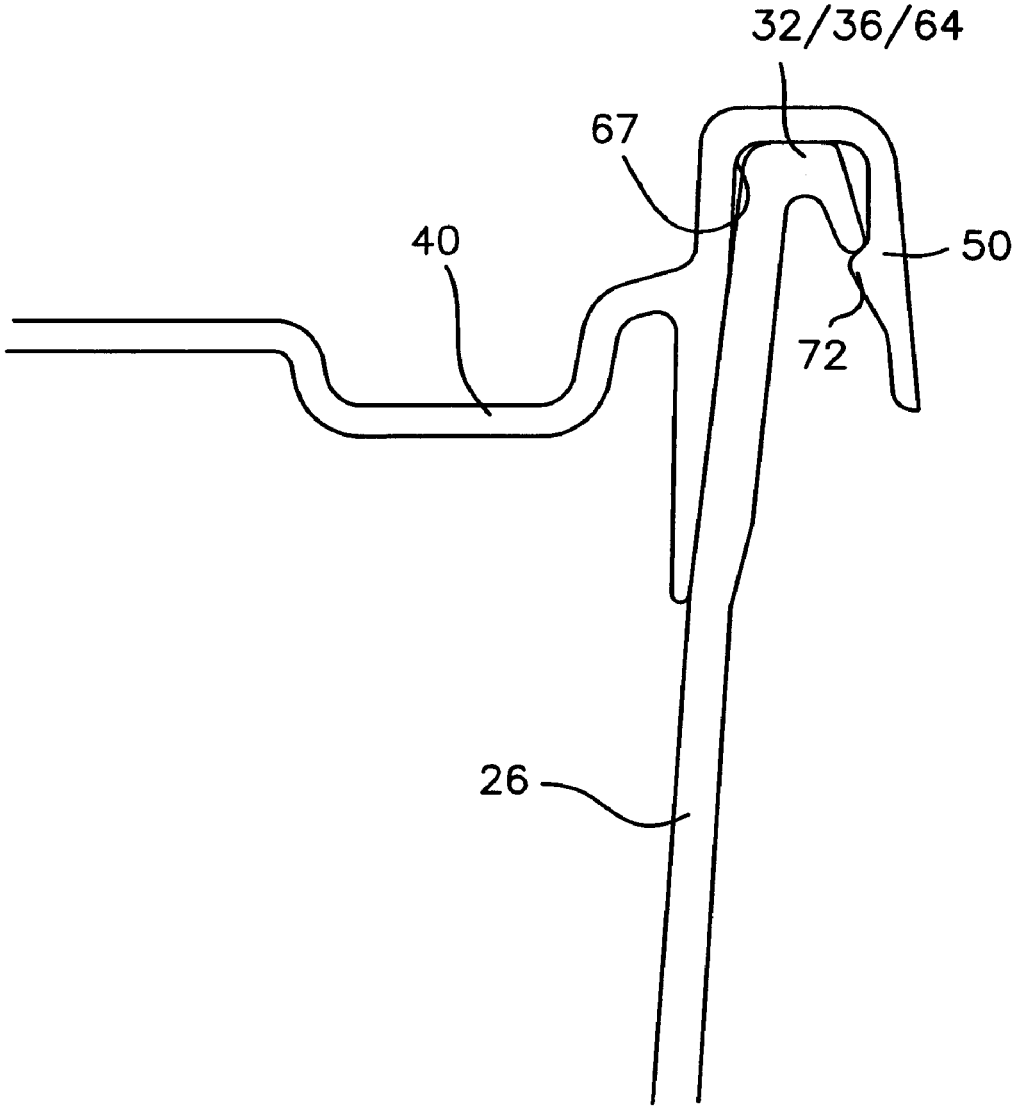
FIG. 20 is a partial cross sectional view of the structure of FIG. 19 taken along line 20—20 of FIG. 19.
Figure 21:
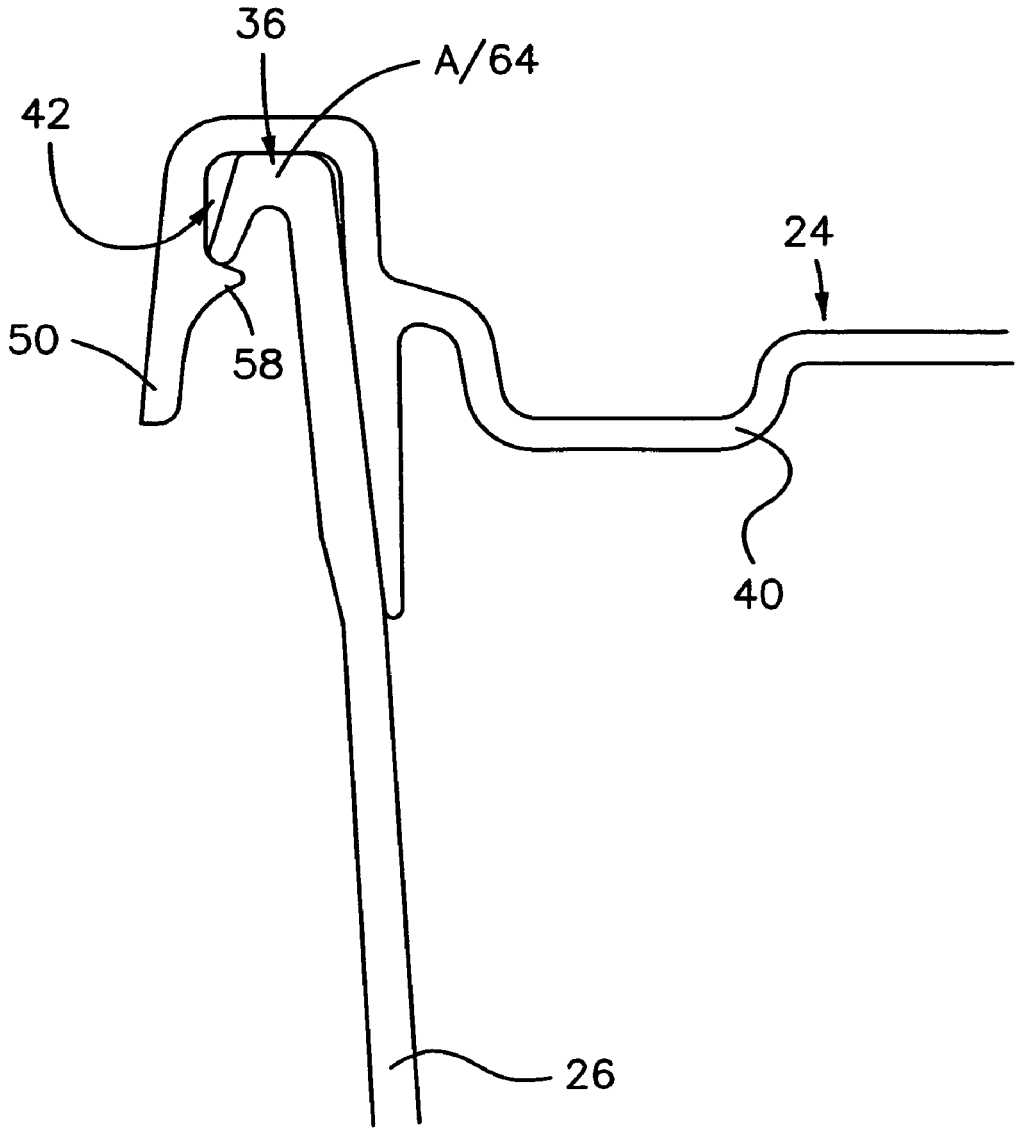
FIG. 21 is a partial cross sectional view of the structure of FIG. 19 taken along line 21—21 of FIG. 19.

Although the embodiments discussed above and illustrated in FIGS. 1 to 15, include a skirt (such as tear off strip 38) and locking flange 28, it should be understood that according to an aspect of the invention, the lid and container of the invention do not necessarily have to include skirt (such as tear off strip 38) and locking flange 28. For example, the lid of the embodiments illustrated in FIGS. 16 to 21 engage the container without being secured thereto by tear off strip portion (shown as item 38 in the previous illustrations) having a lid locking flange 56 gripping the underside of the locking flange 28 to prevent removal of the lid body 40 from the container body. Rather, as is illustrated in FIGS. 16 to 21, the lid and container of the invention does not utilize additional securement from the tear off strip. Such a lid may be, utilized where less rigorous securing is required. In order to have some resistance to removal of the lid from the container in this embodiment, as best seen in FIG. 20, and as is previously described above, the lid body may be formed with a lid locking flange 72 which projects inwardly from the tubular part 50 of the lid body and is preferably located on the side of the lid body opposite to that with which the socket is aligned, and grips the underside of the rim to resist removal of the lid from the rim. Tubular part 50 may be urged slightly outwardly to move the lid locking flange out of engagement with the rim 32 and thereby allow the lid to disengage from that portion of the rim to allow pivoting to the open position about the pintle axis A—A as discussed above.

It will also be understood that various changes in size, shape and arrangement of parts can be made without departing from the spirit or scope of the invention. Accordingly, it is to be understood that the scope of the present invention is limited only by the claims appended hereto, purposively construed.

I claim:

1. Apparatus comprising:

a hollow container body having a thickened peripherally extending rim and an open end bounded by the rim, the rim defining a periphery of the container body and having a linear part which defines a pintle, the pintle defining a pintle axis; and a lid body overlying the rim in a closed position and having a channel formed therein which includes a continuous linear part defining a socket, the continuous linear part of the channel having a continuous concave wall that extends in close-fitting relation over the pintle to hingably couple the lid body to the container body for movement about the pintle axis from the closed position to an open position where the lid body is disposed at an angle to the open end of the container wherein said lid body and container comprise resilient plastic, and said concave wall includes an outer wall portion, said outer wall portion including at least one laterally protruding hooked portion which engages the underside of the linear part of the rim during pivoting from said open position to said closed position, said outer portion of the concave wall being laterally flexible and the hooked portion being dimensioned so as to accommodate disengagement of the lid body from the rim by laterally outwardly flexing of the outer wall portion until the laterally protruding hooked portion is disengaged from the underside of the rim and so as to accommodate installation of said rim into the channel of the lid by pressing the lid onto said rim until the hook portion engages the underside of the rim.

2. An apparatus as recited in claim 1 further comprising a container locking flange peripherally extending around the exterior of the container body in spaced relation to the rim and being rigidly connected to the container body; and a peripheral skirt detachably connected to the lid body and extending therefrom in surrounding relation to the container locking flange, the skirt having an inwardly-disposed lid locking flange which extends peripherally around the container body and grips the underside of the container locking flange to prevent removal of the lid body from the container body, whereby, upon detachment of the skirt, the lid body is pivotally movable between the closed position and the open position.

3. Apparatus according to claim 1, wherein the linear part of the rim has formed thereon, at least one outer, upwardly tapering necked-in portion to facilitate insertion of the linear part of the rim within the linear part of the channel during assembly.

4. Apparatus according to claim 1, wherein the concave wall includes a pair of spaced-apart said protruding hooked portions.

5. Apparatus according to claim 1, wherein the channel extends around the entirety of the circumference of the lid body, the lid body including a tubular part which defines in part the outer wall portion of the channel, the rim being positionable within the channel.

6. Apparatus according to claim 5, wherein the lid body is rectangular and includes a lid locking flange projecting inwardly from the tubular part, said lid locking flange gripping the underside of the rim to releasably resist removal of the rim from the channel when said rim is positioned within said channel.

7. Apparatus according to claim 2, wherein the channel extends around the entirety of the circumference of the lid body, the lid body including a tubular part which defines in part the outer portion of the channel and includes a lid locking flange gripping the underside of the rim to releasably resist removal of the rim from the channel when the rim is positioned within the channel, with the skirt being detachably connected to the tubular part.

8. Apparatus according to claim 6, wherein and the socket is aligned along one side of the lid body.

9. Apparatus according to claim 6, wherein the lid locking flange is located on the side of the lid body opposite to that along which the socket is aligned.

10. Apparatus according to claim 5 wherein said tubular part is sized such that, an end portion of the tubular part extending from the linear part of the channel, is urged into press fit engagement with an outer surface of the container body as said lid body is rotated into said open position, thereby providing releasable support for the lid in said open position.

11. Apparatus according to claim 10 wherein the lid open position is 90 degrees about said pintle axis from said closed position.

12. Apparatus according to claim 7 wherein the tubular part of the lid body and the skirt are formed integrally and divided by a peripheral groove.

13. Apparatus according to claim 7, wherein the tubular part of the lid body is formed with thin membrane windows therein on either side of the lid locking flange and bordering on the peripheral groove, so that detachment of the skirt leaves downwardly disposed thin membrane notches on either side of the lid locking flange.

14. Apparatus according to claim 13, wherein the thin membrane windows are formed with strengthening ribs therein.

15. Apparatus according to claim 6, wherein the tubular part of the lid body is formed with downwardly disposed thin membrane notches on either side of the lid locking flange.

16. Apparatus according to claim 15, wherein the thin membrane notches are formed with strengthening ribs therein.

17. Apparatus according to claim 6 wherein the lid body includes an outer surface, said outer surface including a recessed portion at the position of the lid locking flange, thereby indicating its location.

18. Apparatus as recited in claim 1 wherein said resilient plastic material is polyethelene.

19. Apparatus as recited in claim 1 wherein said resilient plastic material is polypropelene.

20. Apparatus as recited in claim 9 wherein the tubular part includes an end portion extending from the linear part of the channel, and is sized such that the end portion engages an outer surface of the container body when said lid is rotated about the pintle axis to a position less than 90 degrees from the closed position, thereby preventing the lid from being opened beyond said position and urging said lid to return to said closed position.

21. Apparatus as recited in claim 6 wherein said lid body is square having four equidistant sides.

* * * * *